United States Patent [19]

Baker et al.

[11] 4,295,524

[45] Oct. 20, 1981

[54] ISOLATION GRAVEL PACKER

[75] Inventors: Eugene E. Baker; David D. Szarka, both of Duncan, Okla.

[73] Assignee: Halliburton Company, Duncan, Okla.

[21] Appl. No.: 107,739

[22] Filed: Dec. 27, 1979

[51] Int. Cl.[3] ..... E21B 43/04

[52] U.S. Cl. ..... 166/278; 166/51; 166/127; 166/128

[58] Field of Search ..... 166/51, 191, 278, 127, 166/128, 205

[56] References Cited

U.S. PATENT DOCUMENTS

| | | | |
|---|---|---|---|
| 3,153,451 | 10/1964 | Chancellor et al. | 166/51 |
| 3,455,380 | 7/1969 | Salerni et al. | 166/51 |
| 3,627,046 | 12/1971 | Miller | 166/51 |
| 3,637,010 | 1/1972 | Maly et al. | 166/51 |
| 3,726,343 | 4/1973 | Davis, Jr. | 166/278 |
| 3,850,246 | 11/1974 | Despujols | 166/278 |
| 3,963,076 | 6/1976 | Winslow | 166/278 |
| 4,044,832 | 8/1977 | Richard et al. | 166/51 |
| 4,105,069 | 8/1978 | Baker | 166/51 |
| 4,192,375 | 3/1980 | Maly et al. | 166/51 |

*Primary Examiner*—James A. Leppink

*Attorney, Agent, or Firm*—Joseph A. Walkowski; John H. Tregoning

[57] ABSTRACT

A method and apparatus for gravel packing a producing formation or zone in a well without inducing fluid movement across the zone being packed during reverse circulation. Packing and reverse circulation are effected without any movement of the tool string from the time packing is initiated. Bypass and dump valves are incorporated in the isolation gravel packer to facilitate movement of the tool string within the well bore before and after packing a zone.

57 Claims, 20 Drawing Figures

ISOLATION GRAVEL PACKER

SUMMARY OF THE INVENTION

Unconsolidated formations, particularly those containing loose sands and soft sandstone strata, present constant problems in well production due to migration of loose sands and degraded sandstone into the well bore as the formation deteriorates under the pressure and flow of fluids therethrough. This migration of particles may eventually clog the flow passages in the production system of the well, and can seriously erode the equipment. In some instances, the clogging of the production system may lead to a complete cessation of flow, or "killing" of the well.

One leading method of controlling sand migration into a well bore consists of placing a pack of gravel on the exterior of a perforated or slotted liner or screen which is positioned across an unconsolidated formation to present a barrier to the migrating sand from that formation while still permitting fluid flow. The gravel is carried to the formation in the form of a slurry, the carrier fluid being removed and returned to the surface. The proper size of gravel must be employed to effectively halt sand migration through the pack, the apertures of the liner or screen being gauged so that the gravel will settle out on its exterior, with slurry fluid carrying the gravel entering the liner or screen from its exterior. "Reverse circulation" is a widely employed procedure by which wells are packed. Currently, a liner assembly having a perforated liner or screen is positioned across the unconsolidated formation, commonly referred to as the "zone" to be packed, after which a packer is set above the zone between the liner and the well casing, or, if unlined, the well bore wall to isolate that zone from those above. A tubing string is run inside the liner assembly at the area of the zone, there being created between the liner and inner tubing string an annulus. Gravel slurry is pumped into this annulus, out into the annulus between the liner and the casing or well bore wall at a suitable location above the zone where it descends and the gravel is deposited in the area of the screen as the carrier fluid re-enters the liner assembly through the screen, being removed through the inner tubing string. A crossover device incorporated in the packing apparatus routes the returning fluid back outside the liner assembly, the fluid then traveling up to the surface. A pressure buildup is noted at the surface as the gravel level reaches the top of the screen, indicating that a successful pack has been achieved. Thereafter, the flow of gravel-laden fluid is stopped. If desired the crossover may be closed and pressure applied in the same direction as the slurry flow to squeeze the slurry into the formation, thus consolidating the gravel pack. After squeezing, the crossover is opened again and the circulation of fluid is reversed, a clean fluid being pumped down the inner tubing and back up the annulus between it and the liner assembly in order to flush out this area. Subsequently, the well may be subjected to other treatments if necessary, and produced.

Many different devices are presently employed to effect the gravel pack, among them so-called gravel packers which are lowered into place across a gravel collar hung in a liner at the end of a pipe string, a gravel slurry being subsequently pumped through the packer and out the open ports of the gravel collar. These gravel packers have packer cups bracketing the opening through which gravel flows to the gravel collar, which cups isolate the immediate annular space in proximity to the gravel collar from that above and below it. Such a configuration is disclosed in U.S. Pat. Nos. 3,153,451; 3,637,010; 3,726,343 and 4,105,069. While suitable for the packing operation itself, these prior art devices possess a common deficiency in that, when circulation is reversed to clear the pipe string and gravel packer, fluid disturbance is induced across the zone which has just been gravel packed, frequently resulting in damage to the pack. Additionally, manipulation of the tool string by the operator is required to effect reverse circulation.

The present invention contemplates an isolation gravel packer which, in contrast to the prior art, does not disturb the packed zone subsequent to packing during reverse circulation. The present invention contemplates an isolation gravel packer employing two concentric passages therein, the outer through which gravel slurry is pumped to the gravel collar location, which is isolated from areas above and below within the liner by packer cups, the inner of which is employed to take returns of fluid from the tail pipe which extends below the gravel screen. A ball check valve is provided in the inner passage which remains open when returns are being taken, but which seats and closes the bottom of the inner passage when reversing out. Upon closing of the bottom of the passage, flow is re-routed out of the isolation gravel packer inner passage to the annular area below that where the gravel collar is isolated by packer cups during packing. Upon reaching the area outside the packer, downward flow is restricted by an upward-facing packer cup, the fluid then flowing upward, collapsing the upward-facing packer cups which isolated the gravel collar annulus during packing, the fluid then flowing back through the gravel ports of the packer and up the outer passage. Both the inner and outer passages are connected to inner and outer concentric strings of pipe, respectively, above the isolation gravel packer, which may route fluid flow to and from a crossover tool located above the highest zone or, in lieu of a crossover tool, the concentric tubing strings may be run to the surface and surface equipment utilized to control the flow. Bypass passages are incorporated within the isolation gravel packer, which lock closed when the isolation gravel packer is in place for packing and lock open to facilitate upward and downward movement of the isolation gravel packer through the liner without swabbing.

While the isolation gravel packer of the present invention will be described in operation with a particular gravel collar, it will be obvious to those skilled in the art that any suitable collar, or a liner with ports therein, may be employed in gravel packing with the isolation gravel packer disclosed and claimed herein.

DESCRIPTION AND OPERATION OF THE PREFERRED EMBODIMENT

Figure 1:
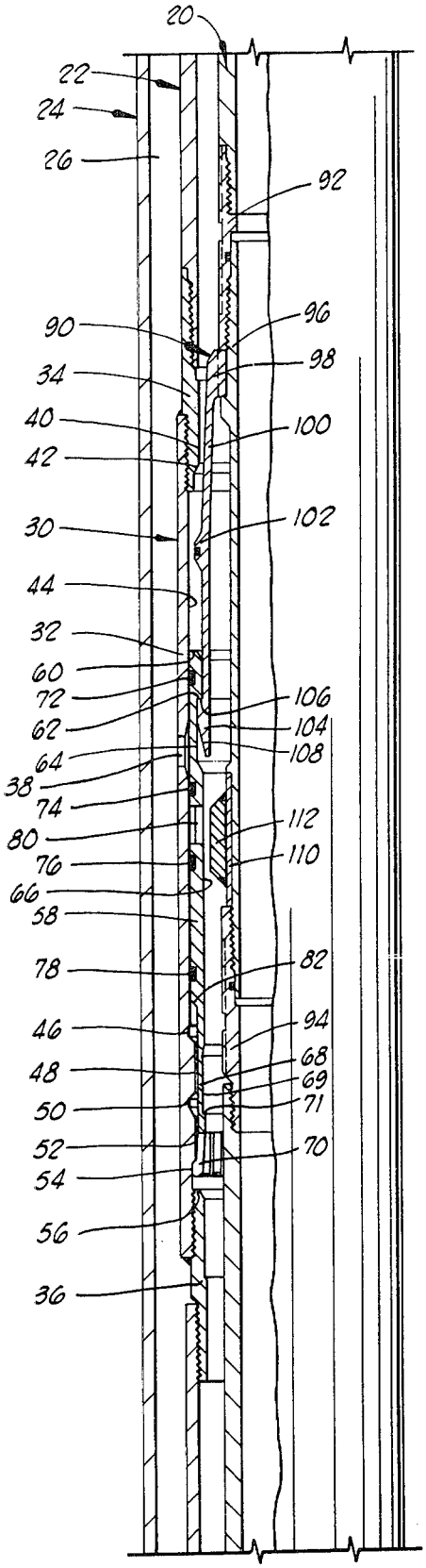
FIG. 1 provides a detailed vertical half-section of a gravel collar which may be employed with the isolation gravel packer of the present invention in the lower closed position, with the spring arm of an opening sleeve positioner engaged.
Figure 2:
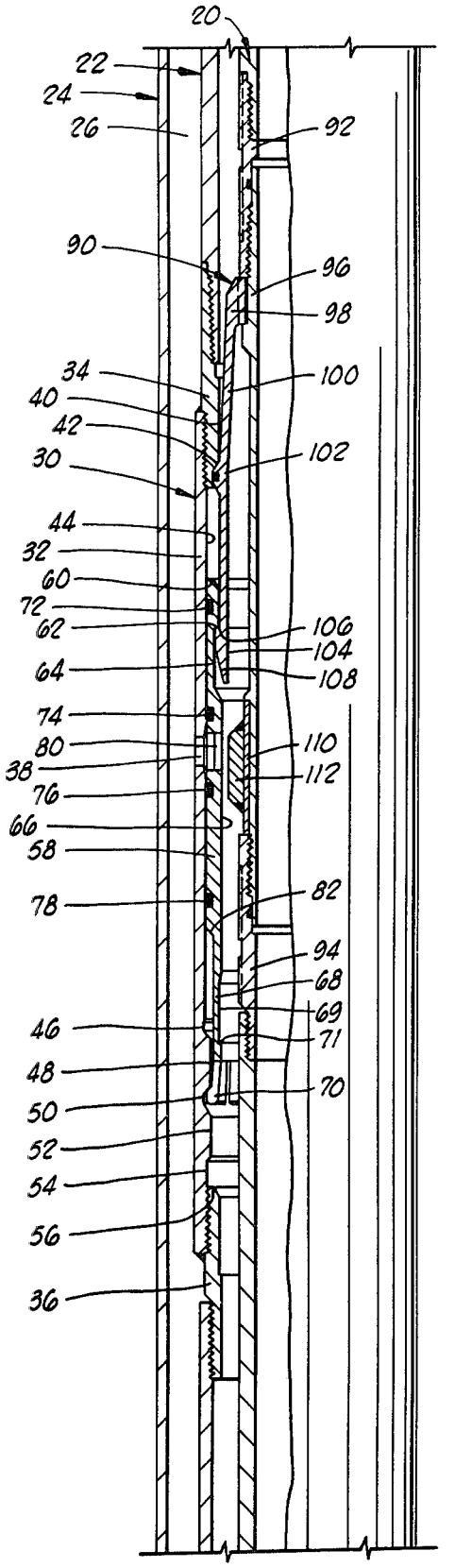
FIG. 2 provides a detailed vertical half-section of the gravel collar of FIG. 1 in the open position, with the spring arm of an opening sleeve positioner about to disengage.
Figure 3:
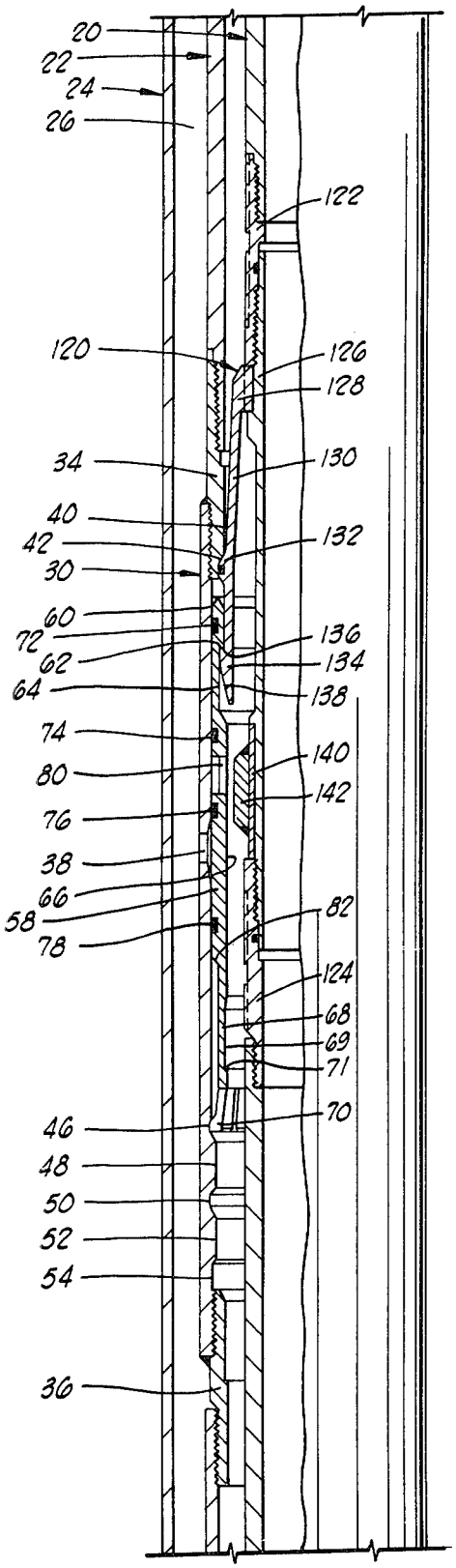
FIG. 3 provides a detailed half-section of the gravel collar of FIG. 1 in its upper closed position, with the spring arm of a closing sleeve positioner about to disengage.

Referring to the drawings, FIGS. 1, 2 and 3 illustrate the operation of the sleeve of a three position gravel collar, while FIGS. 6A through 6D depict an open three position gravel collar with an isolation gravel packer in place to effect gravel packing.

FIG. 1 shows a well casing 24, within which are located liner 22 and tool string 20. As a part of liner 24, above each of the one or more producing formations or "zones," is located a three position gravel collar, generally designated by reference character 30. Gravel collar 30 is closed as shown, during its insertion into the well as part of the liner having a float shoe at the bottom thereof. Gravel collar 30 comprises housing 32 with at least one gravel port 38 therethrough, threadably attached and welded to adapter 34 at its upper end, and adapter 36 at its lower end. Adapters 34 and 36 are in turn threadably attached to the liner 22. Upper adapter 34 possesses a constricted or necked-down inner diameter 40, below which is beveled surface 42. The majority of the interior of housing 32 comprises uniform cylindrical surface 44, through which gravel port 38 extends. By way of illustration, two, three, four or more gravel ports may be employed to increase flow through the tool. Below and contiguous with cylindrical surface 44 is upper annular groove 46, followed by upper annular surface 48, median annular groove 50, lower annular surface 52 and lower annular groove 54. Lower annular groove 54 is followed by shoulder 56 formed by the upper edge of lower adapter 36. Inside housing 32 is slidably disposed sleeve 58, comprising flat upper edge 60, leading on its radially inward extremity by a beveled inner surface, and under which is located a downward-facing radially inward extending annular shoulder 62. Below annular shoulder 62, an area of increased inner diameter 64 forms a recess on the inside of the sleeve 58 followed by a tapered surface leading to cylindrical surface 66 of reduced inner diameter, which extends to skirt 68, at the lower end of which are formed a ring of collet fingers 70 having outwardly radially extending protrusions at their lowermost extremity. The inner surface of skirt 68 is characterized by annular recess 69, having upward-facing annular shoulder 71 at the lowest point thereof. Annular seals 72, 74, 76, and 78 surround sleeve 58, and aperture 80 (as well as others, if a plurality of gravel ports are employed) extends therethrough between seals 74 and 76. Below annular seal 78, downward-facing beveled annular shoulder 82 leads to the exterior of skirt 68. It can readily be seen that contact of shoulder 82 with the axially upper edge of upper annular surface 48 will limit any downward travel of sleeve 58 in the event that lower adapter 36 is not threaded to housing 32 a sufficient distance to act as a stop against collet fingers 70. The gravel collar 30 as depicted in FIG. 1 is in its lower closed position, in which it would enter the casing 24 as part of liner 22. Gravel port 38 is bracketed by annular seals 72 and 74, and aperture 80 by annular seals 74 and 76. Opening sleeve positioner 90 is used to open gravel collar 30, opening sleeve positioner 90 being a part of tool string 20 and attached thereto by adapters 92 and 94. Mandrel 96 of opening sleeve positioner 90 has disposed thereabout spring arm collar 98, from which one or more spring arms designated by reference character 100, depend. Spring arm collar is constrained on mandrel 90 by upper adapter 92. Spring arm 100, which is facing downward, possesses on its outer surface median spring arm shoulder 102, bounded by upper and lower beveled edges. Median spring arm shoulder 102 may have embedded therein a carbide button (unnumbered) as shown to enhance its wear characteristics during contact with the inside of liner 22. At the lower end of spring arm 100, protrusion 104 includes upward facing and radially outward-extending shoulder 106, and outer inwardly-inclined edge 108 leading to a pointed lower tip. Below spring arm collar 98, spline collar 110 with one or more splines disposed thereon, one of which is designated at 112, circumferentially aligned with spring arm 100 (other splines, not shown, being aligned with other spring arms about the circumference of opening sleeve positioner 90). Spline collar 110 is keyed to prevent rotation about mandrel 96. The outer extent of spline 112 is on substantially the same radius as the tip of spring arm 100, whereby spline 112 protects spring arm 100 from damage as tool spring 20 is lowered into the well, facilitates the avoidance of hangups by spring arm 100 on irregularities in the liner or casing, and centralizes the spring arm in the liner.

To open gravel collar 30, upward-facing shoulder 106 on spring arm 100 of opening sleeve positioner 90 is engaged with sleeve shoulder 62 on gravel collar sleeve 58. The recess formed by area 64 on the inside of sleeve 58 allows spring arm 100 to expand radially outward, the two shoulders thus engaging. Median spring arm shoulder 102 will not engage the sleeve shoulder 62 due to the beveled nature of its edges and the compression of the spring arm 100 by contact of spring arm protrusion 104 with inner surface 66 of sleeve 58, which presents entry of median spring arm shoulder 102 into the recess adjacent area 64. When tool string 20 is pulled upward, spring arm 100 pulls sleeve 58 to its median position, illustrated in FIG. 2, at which point gravel collar 30 is opened, gravel port 38 being aligned with aperture 80. It may be noted again that other gravel ports, similar to 38, and apertures, similar to 80 would normally be located around the circumference of the collar, to increase the volume of flow. As shown in FIG. 2, annular seals 74 and 76, bracketing aligned gravel port 38 and aperture 80, prevent any fluid or particulate matter from impinging between housing 32 and sleeve 58 during gravel packing operations. Sleeve 58 is locked in its open position by the entry of the protrusions on outwardly biased collet fingers 70 into median groove 50 after riding up and over lower annular surface 52. Further upward movement of sleeve 58 in response to the pull of opening sleeve positioner 90 is eliminated by the contact of median spring arm shoulder 102 on spring arm 100 with beveled surface 42 leading to necked-down portion 40 on upper adapter 34. The longitudinal disposition of median spring arm shoulder 102 on spring arm 100 is calculated to cause the aforesaid contact when sleeve 58 reaches a position whereby gravel collar 30 is opened, after which the contact and subsequent inward urging of beveled surface 42 and necked-down portion 40 on spring arm 100 through median spring arm shoulder 102 will cause upward-facing shoulder 106 on spring arm protrusion 104 to release sleeve shoulder 62. When tool string 20 is subsequently lowered, as will be discussed hereafter with respect to a gravel packing operation, inclined edge 108 on protrusion 104 riding first on beveled sleeve edge 60 and then on the beveled edge leading to cylindrical inner sleeve surface 66 will allow opening sleeve positioner to move freely downward, by downward force exerted on sleeve 58 being adequately compensated for by the engagement of outwardly biased collet fingers 70 with median annular groove 50.

When gravel collar 30 is to be closed again (as shown in FIG. 3), closing sleeve positioner 120, located on tool string 20 below opening sleeve positioner 90, is employed. Closing sleeve positioner 120 is similar to opening sleeve positioner 90, comprising mandrel 126 having disposed thereon spring collar 128 with one or more spring arms designated at 130 and spline collar 140 with one or more splines 142 aligned with spring arms 100. The spring arms and splines are circumferentially aligned and held in a similar manner to those of opening sleeve positioner 90. Mandrel 126 is attached to tool string 20 by adapters 122 and 124, which also serve to constrain spring arm collar 128 and spline collar 140, respectively. Spring arm 130 has located thereon median shoulder 132, bounded by beveled edges. Median shoulder 132, however, unlike median shoulder 102 on spring arm 100, is located closer to the protrusion 134 at the end of the spring arm 130, spring arm 130 also being shorter than spring arm 100. When upward-facing shoulder 136 on protrusion 134 biases outwardly into the recess adjacent area 64 and engages sleeve shoulder 62, as described previously with respect to opening sleeve positioner 90, an upward pull on tool string 20 will cause gravel collar 30 to change to its upper closed position. As seen clearly in FIG. 3, median spring arm shoulder 132 contacts beveled surface 42 leading to necked-down portion 40 of upper sleeve adapter 34 when sleeve 58 reaches its closed position, and further upward movement on tool string 20 causes spring arm 130 to compress and release the sleeve 58, the shorter length of spring arm 130 and the placement of median sleeve shoulder 132 thereon being calculated to effect the release of sleeve 58 where desired. In the upper closed position, annular seals 76 and 78 bracket gravel port 38 in housing 32, thus preventing any flow therethrough. When closing sleeve positioner is lowered into the well on tool string 20, spline 142 protects spring arm 130, and prevents hangups, as does inclined edge 138, the tip of which is on substantially the same radius as the outer extent of spline 142.

Referring now to FIGS. 6A through 6D, gravel collar 30 is in its open position as shown in FIG. 2. The tool string 20 has been positioned so that isolation gravel packer 300, on tool string 20 is in place to begin gravel packing. Isolation gravel packer 300 includes both gravel packing components per se, combined with a bypass and dump valve assembly to facilitate movement of the device through the liner, as will be explained in detail hereafter.

Isolation gravel packer 300 is hung in the liner from concentric pipes 208 and 210. Bypass sleeve 302 is threadably attached to outer concentric pipe 210, and has fixedly disposed thereon annular collar 306, through which vertical passage 440 extends (it being understood that there is a similar passage on the righthand side of the tool, it being a mirror image of the lefthand side, as shown in simplified form in FIG. 4C). Slidably disposed within the bore of annular collar 306, slip joint mandrel 304, threadably attached to inner blank pipe 208, extends to encompass the upper end of inner mandrel 420, a fluid seal created therebetween by O-rings 416 and 418. Sleeve dump port 318 and sleeve bypass port 324 extend through the wall of bypass sleeve 302, with annular seals 314 and 316 bracketing dump port 318 and annular seals 320 and 322 bracketing bypass port 324. At the lower end of bypass sleeve 302 is disposed a ring of downwardly extending fingers 326 having lugs 328 at the lower end thereof. Below the junction of outer blank pipe 210 and bypass sleeve 302, the outer surface thereof is of a reduced diameter, shown at 308 and 312, having an annular shoulder 310 thereon with tapered edges. The outer diameter of bypass sleeve 302 remains substantially constant down to collet finger apron 326, where it is somewhat reduced. Encircling bypass sleeve 302, bypass housing 330 is in slidable relationship thereto, annular seals 314, 316, 320 and 322 being in slidable sealing contact with bypass housing 330. Housing dump port 332 and housing bypass port 334 extend through the wall of bypass housing 330, which is fixed to upper packer housing 350. At the upper extent of bypass housing 330, a ring of slender collet fingers 336 being radially inward extending upper extremities 338, lies juxtaposed with annular shoulder 310 on the outer surface of bypass sleeve 302. Below collet fingers 336, bypass housing 330 is of substantially uniform inside diameter extending to annular stop 340, of reduced inner diameter. Below stop 340, the inner diameter of bypass housing 330 is again increased at area 342, to accommodate lugs 328 of collet fingers 326. In addition, shown in broken lines at 344, splines are cut in area 342 to cooperate with collet finger lugs 328 and prevent the relative rotation of bypass sleeve 302 and bypass housing 330, which will ensure the circumferential alignment of the dump and bypass ports in the sleeve with those of the housing.

Figure 6A:
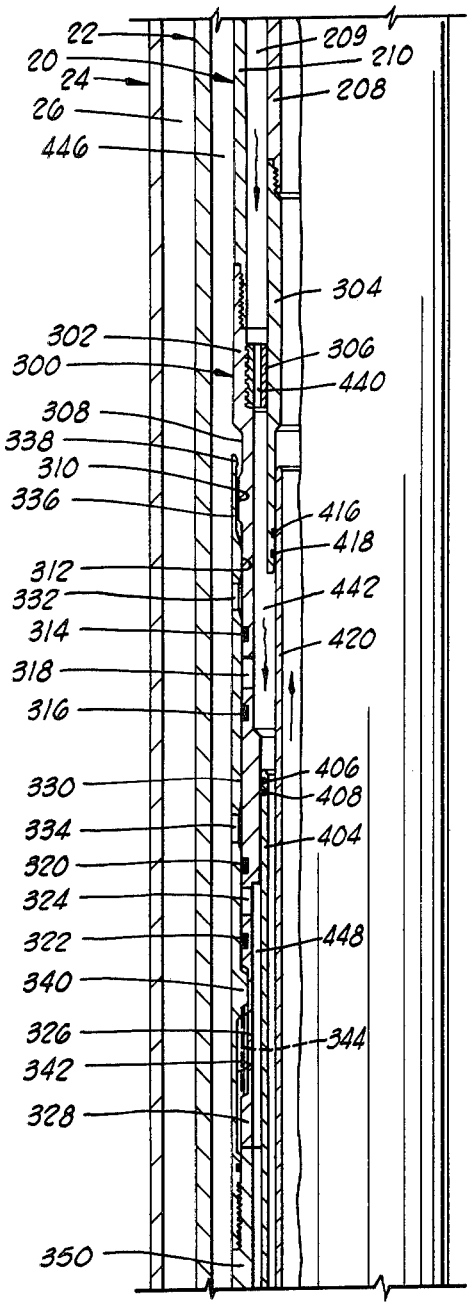
FIGS. 6A, 6B, 6C and 6D provide a detailed vertical half-section elevation illustrating the isolation gravel packer of the present invention in position to gravel pack through the gravel collar of FIG. 1.
Figure 6B:
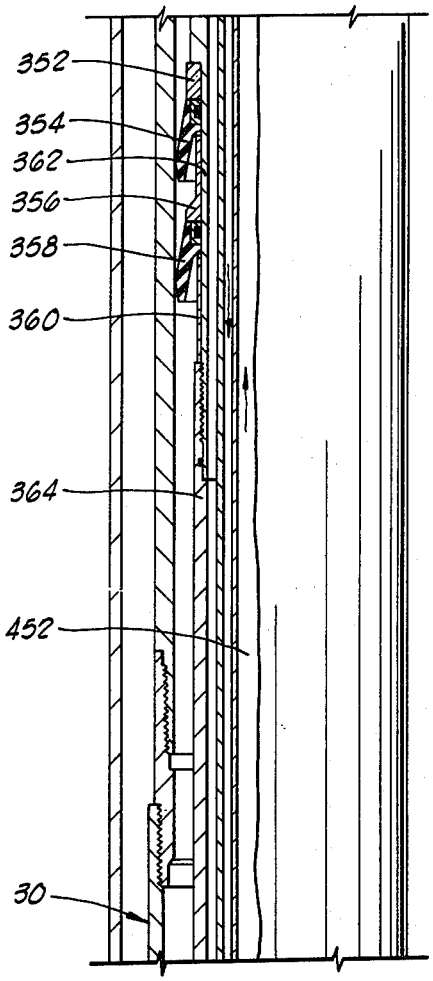

Packer housing 350 is of substantially uniform outer diameter to its lower extremity, at which point area 362 of reduced diameter has disposed thereon packer ring 352, below which is downward-facing packer cup 354, packer spacer 356, downward-facing packer cup 358, and tubular packer standoff 360. As shown in FIG. 6B, the packer cups are axially constrained by the threaded engagement of upper casing 364 with packer housing 350, upper circulation housing acting against packer standoff 360. Fixed to the lower end of upper casing 364 is gravel passage casing 366, having gravel aperture 368 therethrough, gravel passage casing 366 being welded to the interior thereof, gravel passage block 410 having gravel passage 412 therethrough in communication with aperture 368. Gravel passage block 410 is designed to admit fluid therepast, from outer annular passage 448 to annular chamber 450. The inner face of gravel passage block 410 is welded to outer mandrel 404 at the lowest extent thereof, which in turn is welded to ring 414, a fluid seal between ring 414 and inner mandrel 420 being effected by O-rings 422 and 424. The upper end of outer mandrel 404, as shown in FIG. 6A, rides inside of bypass sleeve 302 at an area of reduced inner diameter thereof, a fluid seal between the two being effected by O-rings 406 and 408 during the full extent of any axial travel by bypass sleeve 302.

Figure 6C:
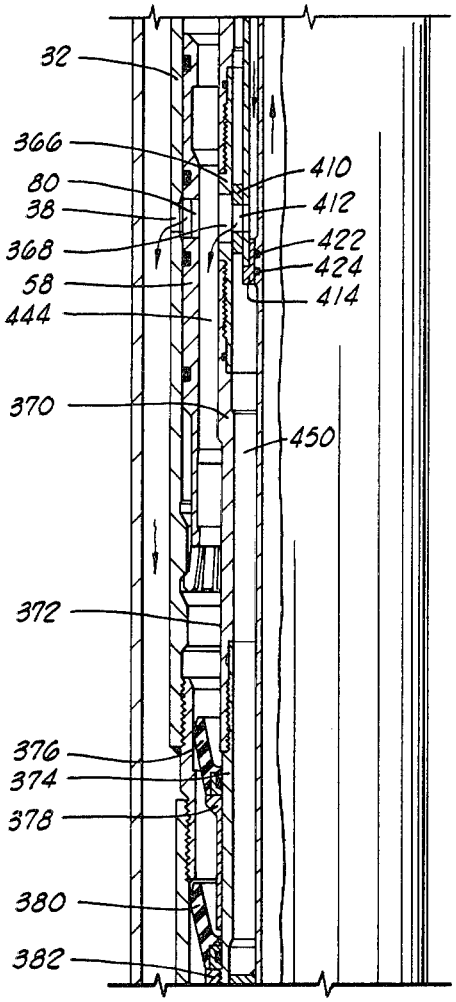
Figure 6D:
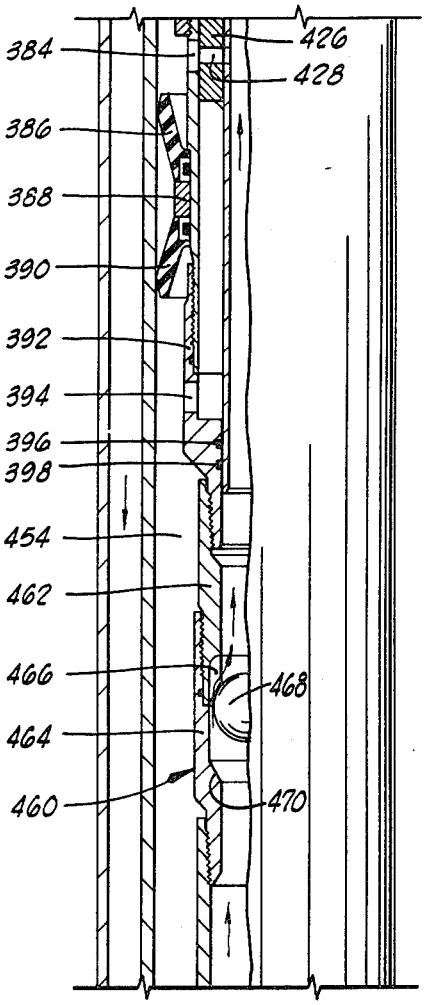

Below gravel passage casing 366, lower casing 370 extends to circulation casing 374 being disposed thereabout upward-facing packer cup 376, packer spacer 378, upward facing packer cup 380, and threaded packer ring 382, fixed to the outer surface of circulation casing 374. The threaded engagement of lower casing 370 and circulation casing 374 provides a constraining shoulder on the upward travel of packer cups 374 and 380 due to the greater outer diameter 372 of lower casing 370 as shown in FIG. 6C, their downward travel being limited by threaded packer ring 382. Adjacent to and below threaded packer ring 382, circulation aperture 384 extends through the wall of circulation casing 374, the inner wall of which has circulation block 426 welded thereto, the latter being circulation passage 428 extending therethrough in communication with circulation aperture 384. Inner mandrel 420 is welded to the interior of circulation block 426, which, as with gravel passage block 410, is designed to permit the passage of fluid axially therearound, from the upper portion of annular chamber 450 to the lower portion thereof. Axial circulation passage 452 of inner mandrel 420, as shown, is in communication with circulation passage 428. Below circulation aperture 384 upward-facing packer cups 386 is backed by packer ring 388, which in turn backs downward-facing packer cup 390. Movement of packer cups 386 and 390 are axially constrained by a slight shoulder on circulation casing 384 above packer cup 386 as shown in FIG. 6D, and by a like shoulder in end casing 392 below packer cup 390. Lower bypass port 394 extends through the wall of end casing 392, connecting the liner annulus 454 below isolation gravel packer 300 with annular chamber 450 thereon. End casing 392 has O-ring 396 and 398 therein, effecting a fluid seal between the interior of end casing 392 and the exterior of the lowest extremity of inner mandrel 420.

Fixed to the lower end of end casing 392, ball check valve 460 comprises upper valve housing 462 and lower valve housing 464 with ball 468 inside. Upper valve housing 462 possesses bypass spider 466 permitting fluid flow therepast even with ball 468 in place. Lower valve housing has seat 470 therein, so that fluid flow in a downward direction is prohibited when ball 468 is seated thereon.

It can be seen that gravel aperture 368 (FIG. 6C) is adjacent gravel port 38 and aperture 80 in gravel collar housing 32 and sleeve 58, respectively, thus enhancing the flow of gravel to casing annulus 26. The flow of gravel slurry entering packer annulus 444 from gravel aperture 368 is constrained at its upper end by packer cups 354 and 358, and at its lower end by packer cups 376 and 380, all being responsive to the fluid pressure of the slurry. Slurry reaches packer annulus 444 from blank pipe annulus 209, vertical passage 440, inner annulus 442, gravel passage 412 and gravel aperture 368. Upward flow from check valve 460, such as would occur during return of slurry carrier fluid through a tail pipe during gravel packing, traverses the length of isolation gravel packer 300 through axial circulation passage 452 of inner mandrel 420, traveling subsequently to the surface through the bore of inner blank pipe 208.

Figure 7A:
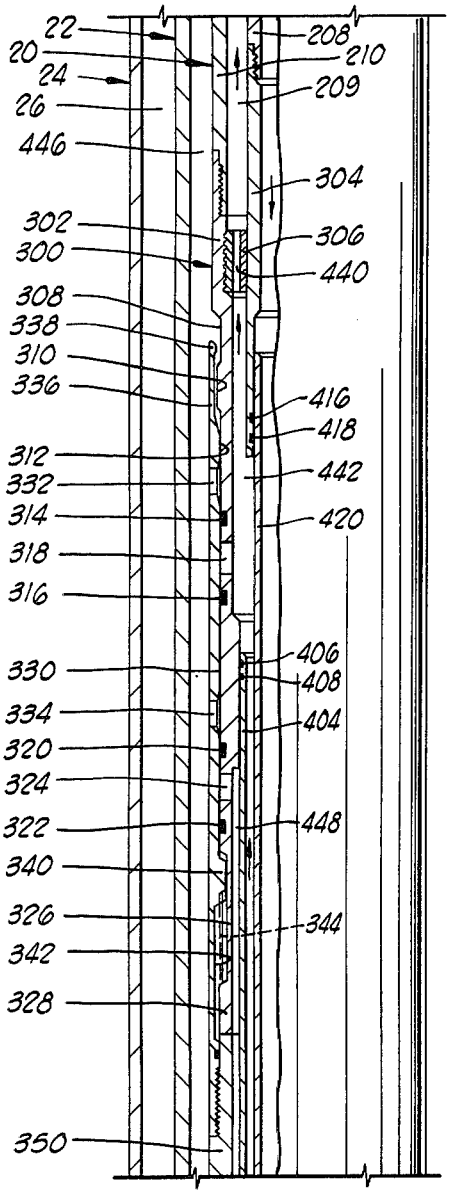
FIGS. 7A, 7B, 7C and 7D provide a detailed vertical half-section elevation of the isolation gravel packer with check valve seated for reverse circulation.
Figure 7B:
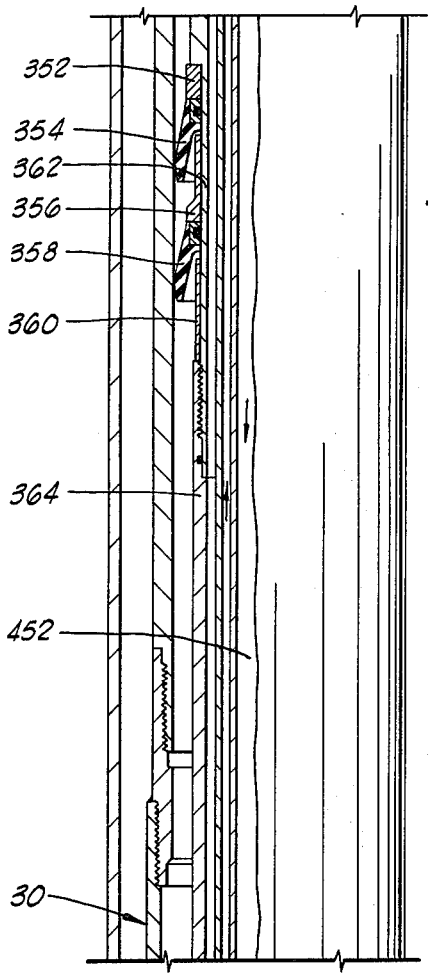
Figure 7C:
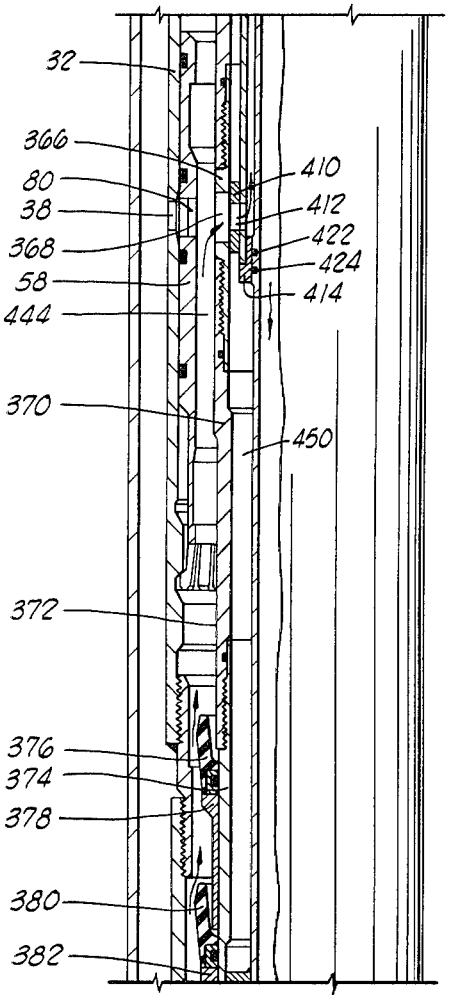
Figure 7D:
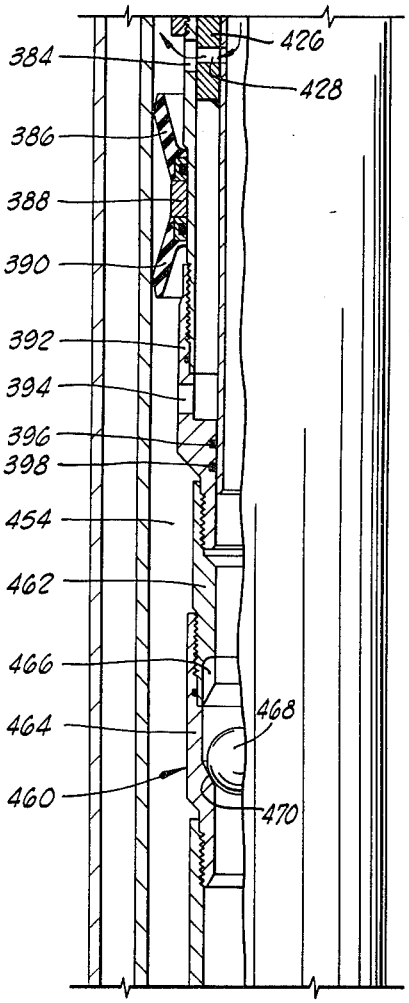
Figure 8A:
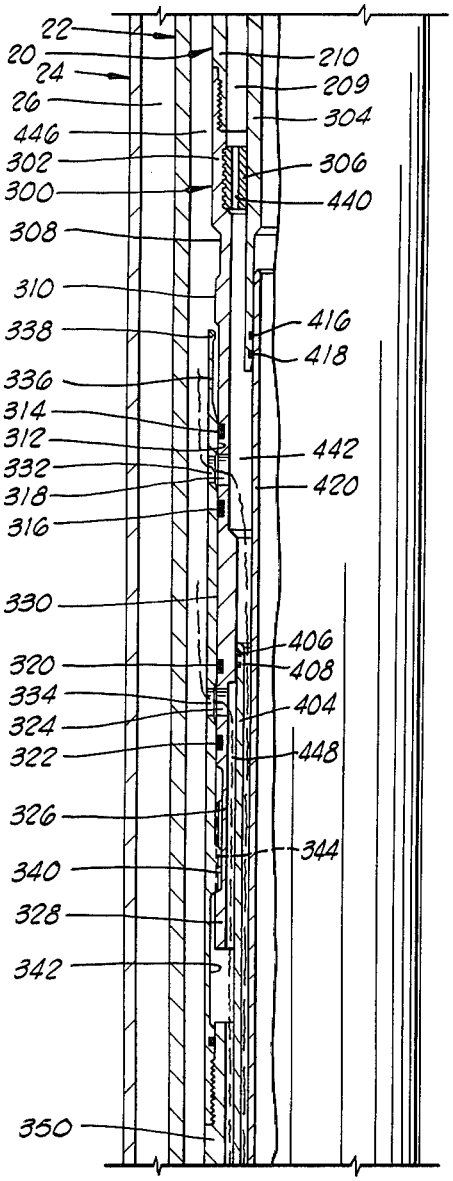
FIGS. 8A, 8B, 8C and 8D provide a detailed vertical half-section elevation of the isolation gravel packer in a blank section of the liner, with dump and bypass valves open.
Figure 8B:
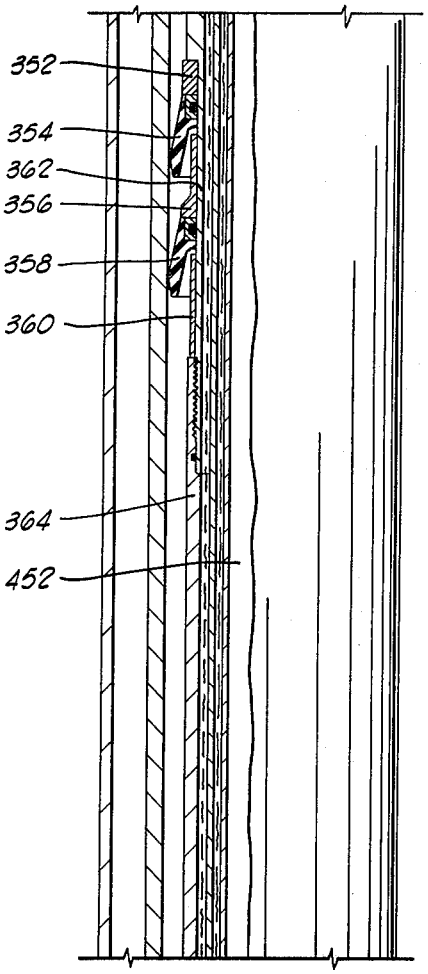
Figure 8C:
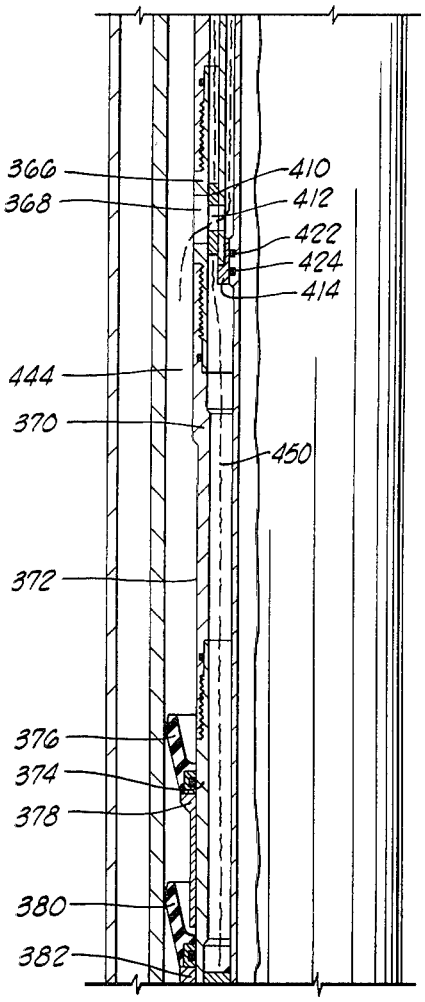
Figure 8D:
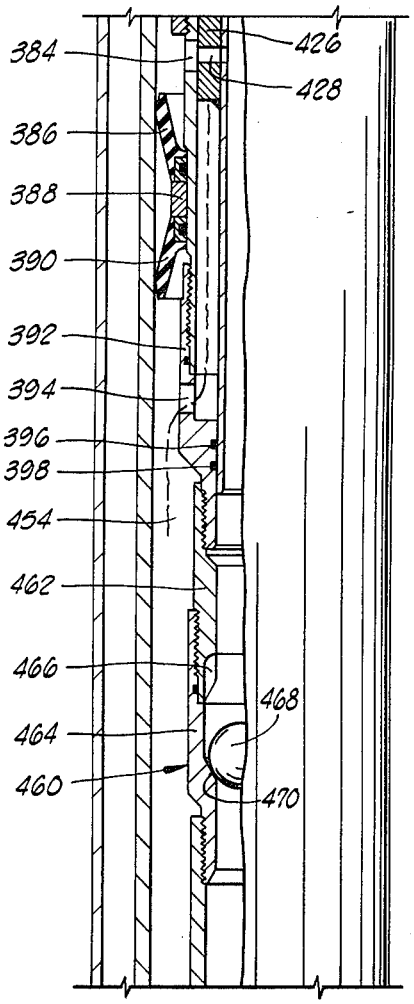

During reverse circulation, when clean fluid is pumped to clear the pipes, the isolation gravel packer 300 and the adjacent annulus between isolation gravel packer 300 and the well bore, is effected with isolation gravel packer 300 in the same position as shown in FIG. 6. The reversal of flow is accomplished, however, through the seating of ball 468 of check valve 460 on seat 470. This seating is effected solely by the reversal of flow, no further action on the part of the operator being necessary. Clean fluid, pumped down blank pipe 208 to axial circulation passage 452 of inner mandrel 420 will seat ball 468, causing the fluid to enter circulation passage 428 through aperture 429, and exit isolation gravel packer 300 through circulation aperture 384. This flow path may easily be traced on FIGS. 7A through 7D, wherein the isolation gravel packer 300 with check valve 460 closed is shown in detail. The pressurized fluid exiting circulation aperture 384 will cause upward-facing packer cups to collapse (as shown in FIG. 7C) and enter the area of packer annulus 444, further upward movement being prevented by downward-facing packer cups 354 and 358. The fluid will then be directed into gravel aperture 368, gravel passage 412 and up inner annulus 442 to blank pipe annulus 209 leading to the surface.

When the tool string 20 is moving through the liner bore, as shown in FIGS. 8A through 8D, it is imperative that fluid be allowed to bypass it so as to avoid swabbing, which could drive fluid into the formations through the gravel screens as well as damage packer cups. To effect this result, bypass sleeve 302 slides within bypass housing 330, so that an upward pull on pipes 208 and 210 will result in the upward movement of bypass sleeve 302 with respect to bypass housing 330. Annular shoulder 310 on bypass housing 302 rides upward under collet finger extremities 338, which provide a locking arrangement against small upward and downward forces. The upward movement of bypass sleeve 302 is restricted by contact of stop 340 in bypass housing 330 with the lugs 328 of fingers 326 at the lower end of bypass sleeve 302. In the extended position of bypass sleeve 302, dump port 318 in bypass sleeve 302 is juxtaposed with dump port 332 in bypass housing 330, FIG. 8A. This permits communication (path shown by broken lines) between annulus 446 above isolation gravel packer 300 and packer annulus 444 through dump port 332, dump port 318, inner annular passage 442, gravel passage 412, and gravel aperture 368. Thus, during upward movement, which will collapse packer cups 354 and 358, and set packer cups 376 and 380, the column of fluid above packer cups 376 and 380 can exit the area of the packer annulus 444 and return to the top of the isolation gravel packer as it displaces fluid during its upward movement. Similarly, when bypass sleeve 302 is extended, bypass port 324 will be aligned with bypass port 334 in bypass housing 330, FIG. 8A. In this case, the annulus 446 above isolation gravel packer is put in communication (path shown again by broken lines) with annulus 454 therebelow through dump port 334, dump port 324, outer annular passage 448, past gravel passage block 410 into annular chamber 450 past circulation block 426 and through lower bypass port 394. Downward movement of isolation gravel packer 300 is thus facilitated as the column of fluid held by downward-facing packer cups 390 can exit the annulus 454 and travel up to the annulus 446 above the isolation gravel packer 300 as it displaces the fluid.

The bypass portion of isolation gravel packer 300 is disposed so that a substantial downward force, for example 20,000 pounds must be applied to close the dump and bypass ports. Upper extremities 338 prop up bypass sleeve 302 by their contact with the lower side of annular shoulder 310 when bypass sleeve 302 is extended. When the isolation packer is anchored in place for packing, as will be discussed hereafter, then such a downward force may be applied. When upward movement of the tool string 200 is effected after packing, the initial drag of fluid and the force exerted before the tool string is unanchored will open the dump and bypass ports.

Full open gravel collar 30 is designed to require approximately 10,000 pounds of force to move sleeve 58 upward, during which operations the dump and bypass ports of isolation gravel packer 300 may be open, as they will be closed again if the tool string 20 is anchored for packing and downward force is applied. Thus, there is no problem encountered if the 10,000 pound force is exceeded momentarily as in all likelihood the dump and bypass ports are already open, and in any event will be reclosed before gravel packing.

Referring now to the drawings, and to FIGS. 1A through 1D and 5 in particular, full open gravel collar 30 and an isolation gravel packer 300 in a liner and tool string, respectively, are illustrated in simplified form for the sake of clarity in depicting a gravel packing operation. The tool string is generally designated by the reference character 20, while the liner concentrically surrounding it is designated by the reference character 22. Disposed about the two concentric strings is well casing 24, having perforations therethrough at the levels of two unconsolidated producing formations 150 and 152, through which the well bore passes. Should the gravel pack procedure discussed herein be employed in a well that does not employ a liner, the components referred to as incorporated therein, such as full open gravel collars, may be incorporated in the well casing 24, utilizing a suitably sized tool string within.

Liner 22 is secured within well casing 24 by means of a suitable liner hanger casing packer 156, as illustrated schematically. Liner hanger 154 is positioned in casing 24 by means of slips 160 employed in mechanically setting packer 156. Threaded collar 158 is employed to secure liner 22 to a drill string during its installation in the well bore inside the well casing 24.

Moving downwardly from liner hanger assembly 154, the liner comprises a length of blank pipe 162 to a location just above the highest zone to be packed. At that point is located a casing inflation packer, illustrated schematically at 164. Annular space 166 defined by mandrel 168 and elastomeric outer wall 170 is inflated by pumping fluid through schematically illustrated check valve 172 to a predetermined pressure.

Below packer 164 is located a full open gravel collar 30, as heretofore described but shown in simplified form comprising housing 32 within which is slidably disposed sleeve 58. At the top of housing 32 is located necked-down portion 42, bounded by beveled edges. Below necked-down portion 42 is inner cylindrical surface 44, through which gravel ports 38 and 38' extend. Below inner surface 44 is shown annular surface 48, followed by median annular groove 50, annular surface 52 of substantially the same inner diameter as annular surface 50, and lower annular groove 52. Upper annular groove has not been shown for simplicity. Inside housing 32 sleeve 58 has disposed thereabout annular seals 72, 74, 76 and 78. At the top of sleeve 58 is located downward facing annular shoulder 62. Between annular seals 74 and 76 apertures 80 and 80' communicate with gravel ports 38 and 38' when aligned therewith. At the lowest extremity of sleeve 58 are located a ring of collet fingers 70 having radially outward extending lower ends.

Polished nipple 174 is below gravel collar 30, below which is anchor tool 176. Anchor tool 176 has upward-facing annular shoulder 178, bounded by annular recesses. Blank pipe 180 is immediately below anchor tool 176.

Gravel screen 182 is disposed across the upper producing formation or zone of interest 150 below blank pipe 180.

Referring to the lower zone of interest, casing inflation packer 184, substantially identical to packer 164, is located below gravel screen 182 to isolate the upper zone of interest from the lower zone. Space 186 defined by mandrel 188 and elastomeric outer wall 190 is inflated by pumping fluid through schematically illustrated check valve 192 to a predetermined pressure.

Below packer 184 is located a second full open gravel collar 30 in the open position, gravel ports 38 and 38' being aligned with apertures 80 and 80'.

Second anchor tool 196 is located below polished nipple 194, below lower gravel collar 30. Anchor tool 196 possesses upward-facing annular shoulder 198, bounded by annular recesses.

Gravel screen 202 is disposed across the lower producing formation or zone of interest below blank pipe 200. Gravel screens 182 and 202 are fore-shortened in the drawings herein, and actually may be a number of feet in length, the length being determined by the thickness of the producing formation to be gravel packed, all of which is evident to those skilled in the art, it being further evident that the gravel screens may have perforations, as shown, or may employ wire-wrapped slots to form the desired perforations.

Another length of blank pipe 204 is attached below gravel screen 202, and the lowest end of the pipe is capped with a float shoe 206.

It should be noted that the proper orientation of tool string 20 with respect to liner 22 is dependent upon the polished nipples 174 and 194 being of the appropriate length to position isolation gravel packer 300 (see FIG. 1C) across gravel collar 30 when the tool string 20 is anchored in place at the zone being packed.

The liner 22 having been described, the tool string 20 will now be described from the top thereof downward.

Inner blank pipe 208 and concentric outer blank pipe 210 extend downward to isolation gravel packer 300 from the surface. As the two lengths of pipe cannot be matched exactly, it is of course necessary to include a fluid-tight slip joint and swivel assembly illustrated in simplified form at 212 in the inner string of pipe.

Blank pipes 208 and 210 enter the top of isolation gravel packer 300, heretofore described in detail. At the top end of isolation gravel packer 300 is located upper body 302, at which point blank pipe 208 communicates with axial circulation passage 452 and the annulus 209 between pipes 208 and 210 communicates with outer passages 440 and 440'. The components of isolation gravel packer 300 in FIG. 4C are numbered to correspond to the components heretofore described in detailed FIGS. 6A through 6D, it being noted, however, that some components havve been omitted in FIC. 4C for the sake of clarity as not essential to the description of a gravel-packing operation.

Figure 4A:
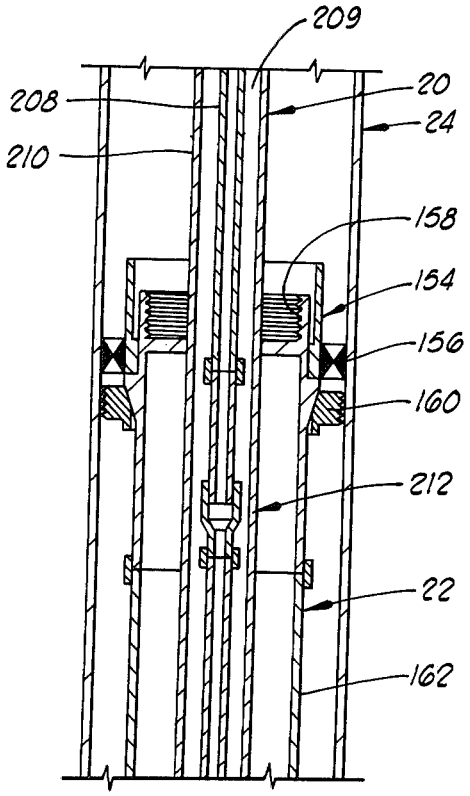
FIGS. 4A, 4B, 4C and 4D provide a simplified vertical cross-sectional elevation of the isolation gravel packer as used with a full tool string during gravel packing.
Figure 4B:
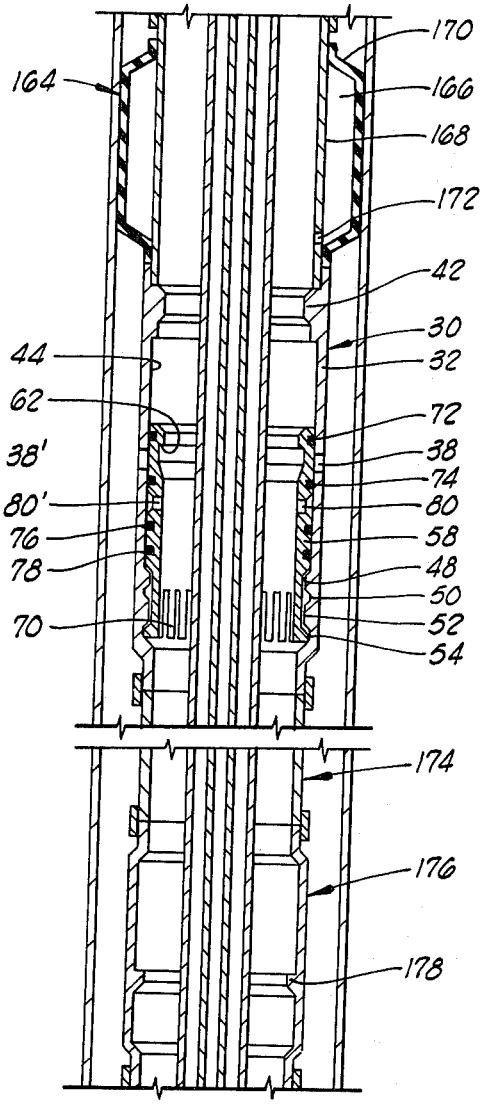
Figure 4C:
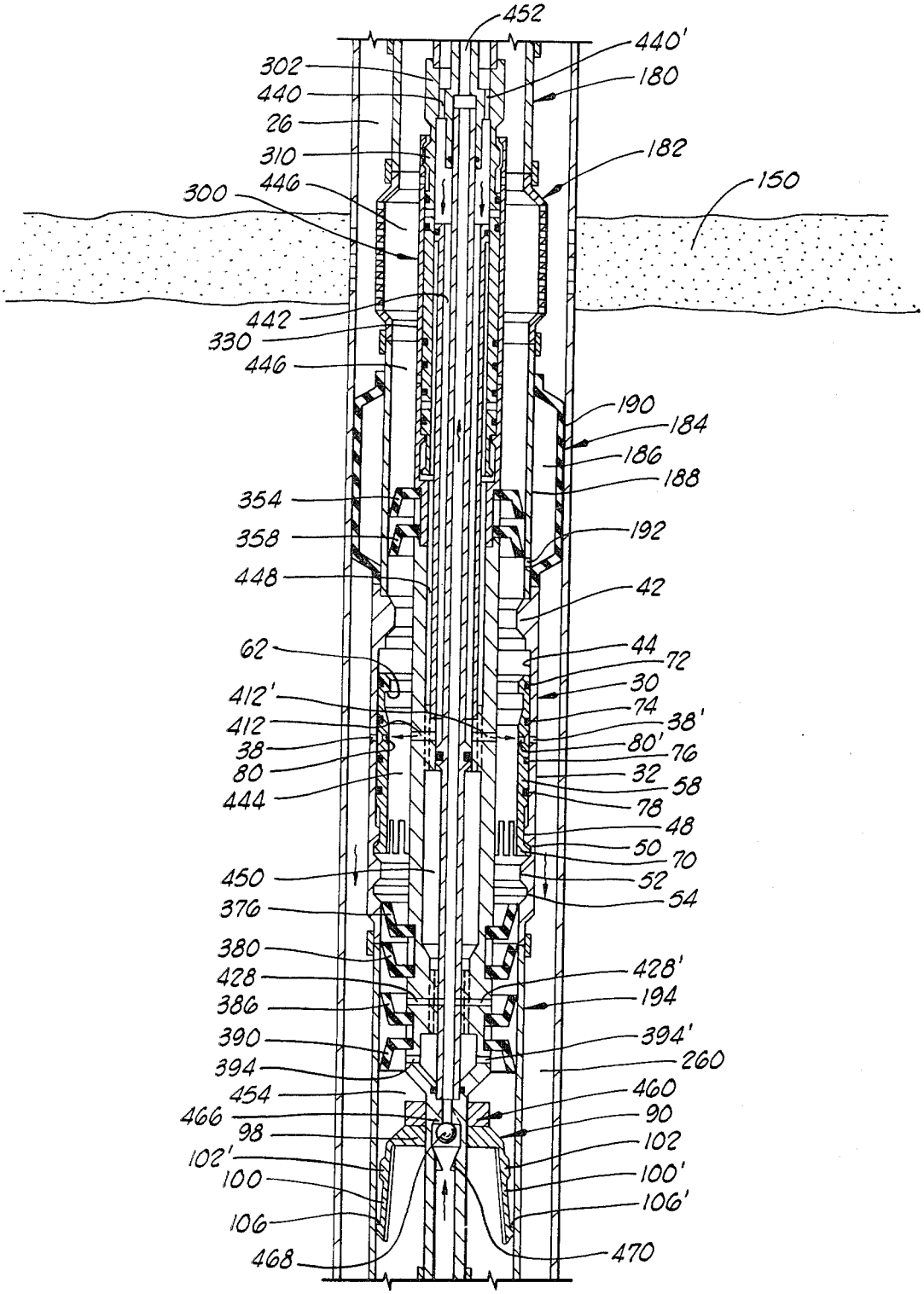

Shown in FIG. 4C at approximately the same location as ball check valve 460 is opening sleeve positioner 90, comprising spring collar 98 and spring arms 100 and 100', possessing radially outwardly extending median shoulders with beveled edges. At the ends of the spring arms are located protrusions, each having an upward-facing radially outward extending shoulder 106 and 106' at the top thereof, the lower outside face of each protrusion being beveled inwardly in a downward direction. Spring arms 100 and 100' are shown in a slightly compressed position against the interior of liner 22 at polished nipple 194.

Below opening sleeve positioner 90 in tool string 20 is located anchor positioner 220. Anchor positioner 220 comprises drag block assembly 222 and spring arm body 224. Drag block assembly 222 is slidably mounted on mandrel 226, in which is located J-slot 228. Pin 230 is fixed to drag block assembly 222, and slides within J-slot 228. On the interior of drag block assembly 222 are spring-loaded drag blocks 232 and 234, shown schematically, which press against the inside of liner 22, thus centering the anchor positioner 220. The lower face 236 of drag block assembly is frustoconical in configuration, being inclined inwardly and upwardly from the lowest extremity thereof. Below drag block assembly 222, spring arm body 224 possesses upward-facing spring arms 238 and 240, similar to those of opening sleeve positioner 90. Spring arms 238 and 240 possess radially outward extending median shoulders, as well as protrusions at their upper ends. The shoulders have beveled edges, and the protrusions have downward-facing radially outward extending shoulders at the bottom, and upwardly extending inwardly-beveled faces at the top. The uppermost points of these faces are disposed on a radius less than the lowermost extremity of drag block assembly 222, thus permitting the inclined face 236 to slidably engage and compress the spring arms 238 and 240 when operating string 20 is pulled upward. As J-slot 228 is truly "J" shaped, pulling up on tool string 20 will cause pin 230 to travel to the bottom of slot 228, which is below the shorter longitudinal portion of the "J", anchor positioner 220 locking in a retract position when the tool spring 20 is set down, pin 230 entering the shorter longitudinal portion of the "J".

Below anchor positioner 220 is located closing sleeve positioner 120, comprising spring arm collar 128 on which are mounted downward-facing spring arms 130 and 130'. Each spring arm possesses outward radially extending median shoulders 132 and 132', the edges of which are beveled, and at the lowest end of the spring arms are located protrusions, having upward-facing outwardly radially extending shoulders 136 and 136' at their upper edges, and downward inwardly beveled edges on their lowermost exteriors. Spring arms 130 and 130' are shown in slightly compressed positions against the interior of liner 22 at blank end pipe 204.

At the lowest extremity of operating string 20 is tail pipe 250, having bore 252 which communicates with bore 254 extending through anchor positioner mandrel 226 up to check valve 460.

Referring again to FIGS. 4 and 5, a gravel-packing operation will be described. After the well is drilled and casing 24 inserted it is perforated at the appropriate intervals adjacent formations 150 and 152, washed and possibly treated in some manner. At this point, liner 22 is lowered into the well bore and hung within casing 24 by liner hanger assembly 154.

The liner 22 as installed in the casing, comprises as many full open gravel collars as there are zones to be packed, designated by the reference character 30. As stated previously, the upper and lower gravel collars 30 are located above their respective zones to be packed, while corresponding gravel screens 182 and 202 are located adjacent to and spanning these zones. Between each gravel collar and its corresponding gravel screen are located polished nipples 174 and 194, and anchor tools 176 and 196, respectively, which accurately position the tool spring 20 at each zone when the anchor positioner 220 is engaged in the appropriate anchor tool.

Above the upper zone is located suitable casing inflation packer 164, and below the zone is suitable casing inflation packer 184, which, when inflated isolate the upper zone from the zone below and the well annulus above. If the upper zone is extremely close to liner hanger assembly 154, packer 164 may be deleted as redundant when a liner assembly with a sealing element is employed such as illustrated schematically at 156. If it is desired to isolate zones not only from each other but from the intervals between formations, packers may be employed above and below each zone. For example, if the upper zone in the present instance was far above the lower zone, an additional casing inflation packer might be utilized in the liner 22 above packer 184 and yet below the upper zone, additional anchor tools being placed at proper intervals in the liner.

After the liner 22 is hung in the casing, the tool string 20 is run into the well bore. The operator has the option of inflating casing inflation packers 164 and 184 as the tool string 20 is going down the well bore, or he may elect to inflate the packers from the bottom as he proceeds upward. He may, in fact, inflate the packers in any order but for purposes of discussion the methods of inflating packers from the bottom up will be more fully described hereinafter.

Figure 4D:
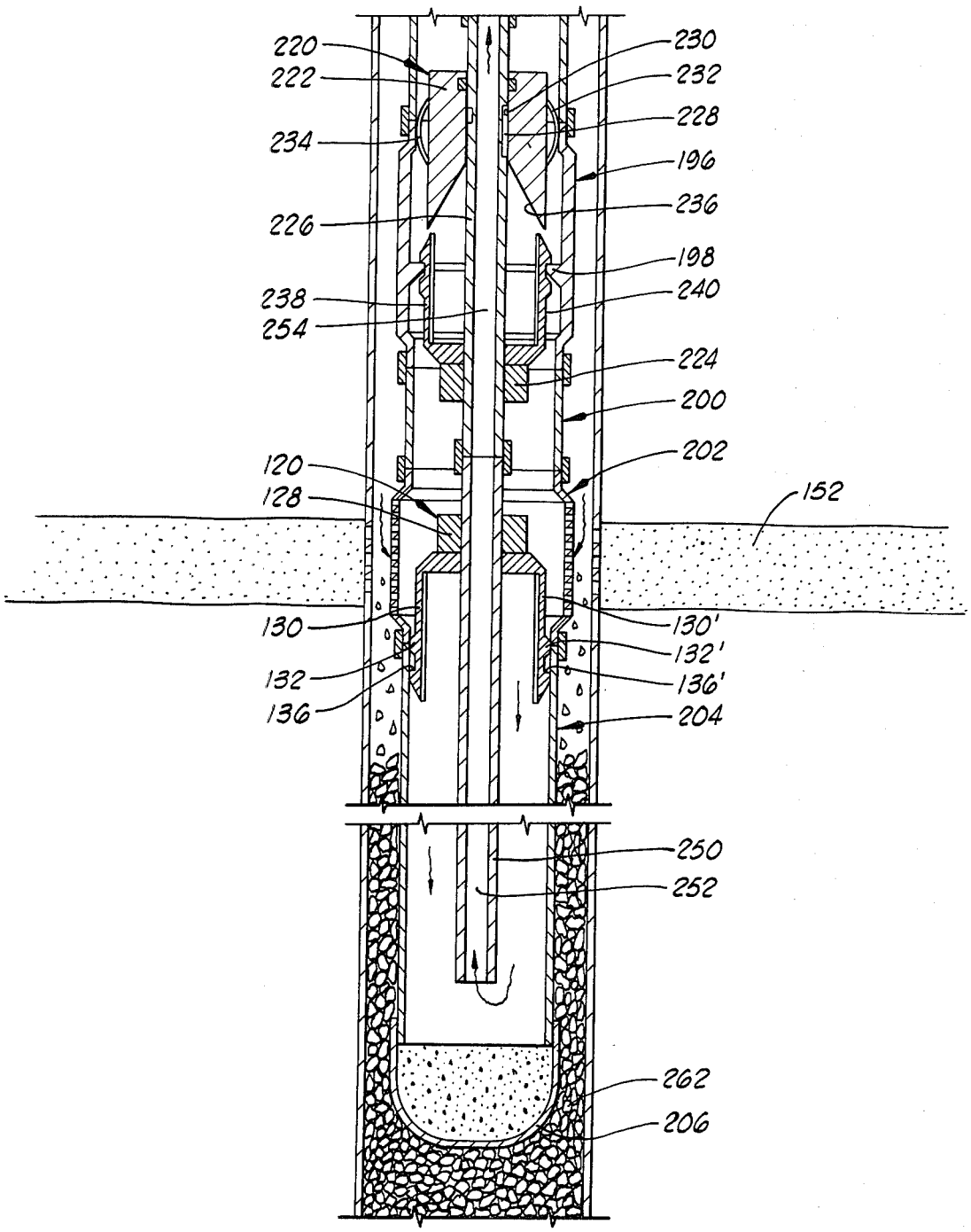

With anchor positioner 220 in its retract mode (drag block assembly 222 compressing spring arms 238 and 240), tool string 20 is lowered to the approximate location of the lowest zone and anchor tool 196. The tool string 20 is then reciprocated upward, rotated 30° to the right and set down to effect the release mode, anchor positioner being then lowered to engage shoulder 198 of anchor tool 196 as shown in FIG. 4D. If the anchor positioner happens to be released below anchor tool 196, it may be raised through it even in the release mode, as the inclined outer edges of the protrusions thereon will guide spring arms 238 and 240 past shoulder 198. Anchor positioner 220 is locked in position when the downward-facing shoulders on the protrusions at the ends of spring arms 238 and 240 are resting on shoulder 198. At this point, unlike FIG. 4C, full open gravel collar 30 will be closed (as shown in FIG. 4B), as no steps have yet been taken to open it. Thus, inflation port 92 of casing inflation packer 184 is spanned by downward-facing packer cups 354 and 358 and upward-facing packer cups 376 and 380 of isolation gravel packer 300. As the packer cannot be inflated while the dump and bypass ports in isolation gravel packer 300 are open, it is necessary to set approximately 20,000 pounds of weight on the anchor to close them as noted previously herein. When the weight is set bypass sleeve 302 moves downwardly with respect to bypass valve body 330, to the position shown in FIG. 4C, isolating the dump and bypass port in bypass housing body 330 from their cooperating ports in bypass sleeve 302, preventing fluid movement between annulus 446, and packer annulus 444 and annulus 454 below isolation gravel packer 300. It is understood, of course, that the bypasses are open during the trip into the well and remain so until a substantial downward force is exerted. All necessary bypasses being closed, the tool string 20 is then pressured to the desired pressure through blank pipe annulus 209 to inflate casing inflation packer 184. The pressurized fluid reaches packer 184 through blank pipe annulus 209, outer passages 440 and 440', inner annular passage 442 then gravel passages 412 and 412' which exit into packer annulus 444 defined by the interior of liner 22, the exterior of isolation gravel packer 300, packer cups 354 and 358 at the top, and 376 and 378 at the bottom. From packer annulus 444, fluid enters casing inflation packer 184 through check valve 192, inflating it to a predetermined pressure. The casing inflation packer being inflated, gravel packing may now proceed at the lowest zone as described hereafter.

Full open gravel collar 30 at the lower zone is opened by pulling up tool string 20 to retract the anchor positioner 220, and raising the tool string 20 so that opening sleeve positioner 90 engages sleeve 58 of full open gravel collar 30. Spring arms 100 and 100' of opening positioner 90 expand and the shoulders on protrusions 106 and 106' engage annular shoulders 62 on sleeve 58. A pull of approximately 10,000 pounds will align apertures 80 and 80' of sleeve 58 with gravel ports 38 and 38' of housing 32, thereby opening the gravel collar 30. As the open position of full open gravel collar 30 is reached, radially outward extending median shoulders 102 and 102' have contacted the beveled edge leading to necked-down portion 42, which contact compresses spring arms 100 and 100' causing them to release from sleeve 58, leaving gravel collar 30 in the open position. The tool string 20 is then lowered to the approximate location of the anchor 198, picked up, rotated to the right and then lowered to release the anchor positioner 220, and engage anchor 198.

A slurry of carrier fluid containing gravel is pumped down blank pipe annulus 209 into passages 440 and 440', inner annular passage 442 and out through gravel passages 412 and 412' into packer annulus 444, then through gravel ports 38 and 38' of full open gravel collar 30 into lower zone annulus 260, where the gravel is deposited to form pack 262. The carrier fluid returns into liner 22 through gravel screen 202, the gravel being retained on the outside of the screen 202 by virtue of the proper sizing of the apertures thereof. The gravel-free carrier fluid then enters tail pipe bore 252, and returns past ball check valve 460, the ball 468 of which is unseated by fluid passing in an upward direction. The fluid then proceeds through axial circulation passage 452 in isolation gravel packer 300, then up through inner blank pipe 208 to the surface. Circulation of the gravel slurry is continued to build up the gravel pack 262 from below gravel screen 202 at a point above it, thus interposing a barrier to sand migration from the zone into the liner 22. When pressure resistance is noted at the surface, this indicates that gravel in the lower zone has been deposited (packed) higher than the top of gravel screen 202, and the pack has been completed. It is evident that no fluid movement has been induced across upper zone 26, during packing, as both gravel slurry and returns are contained within the tool string 20.

Figure 5:
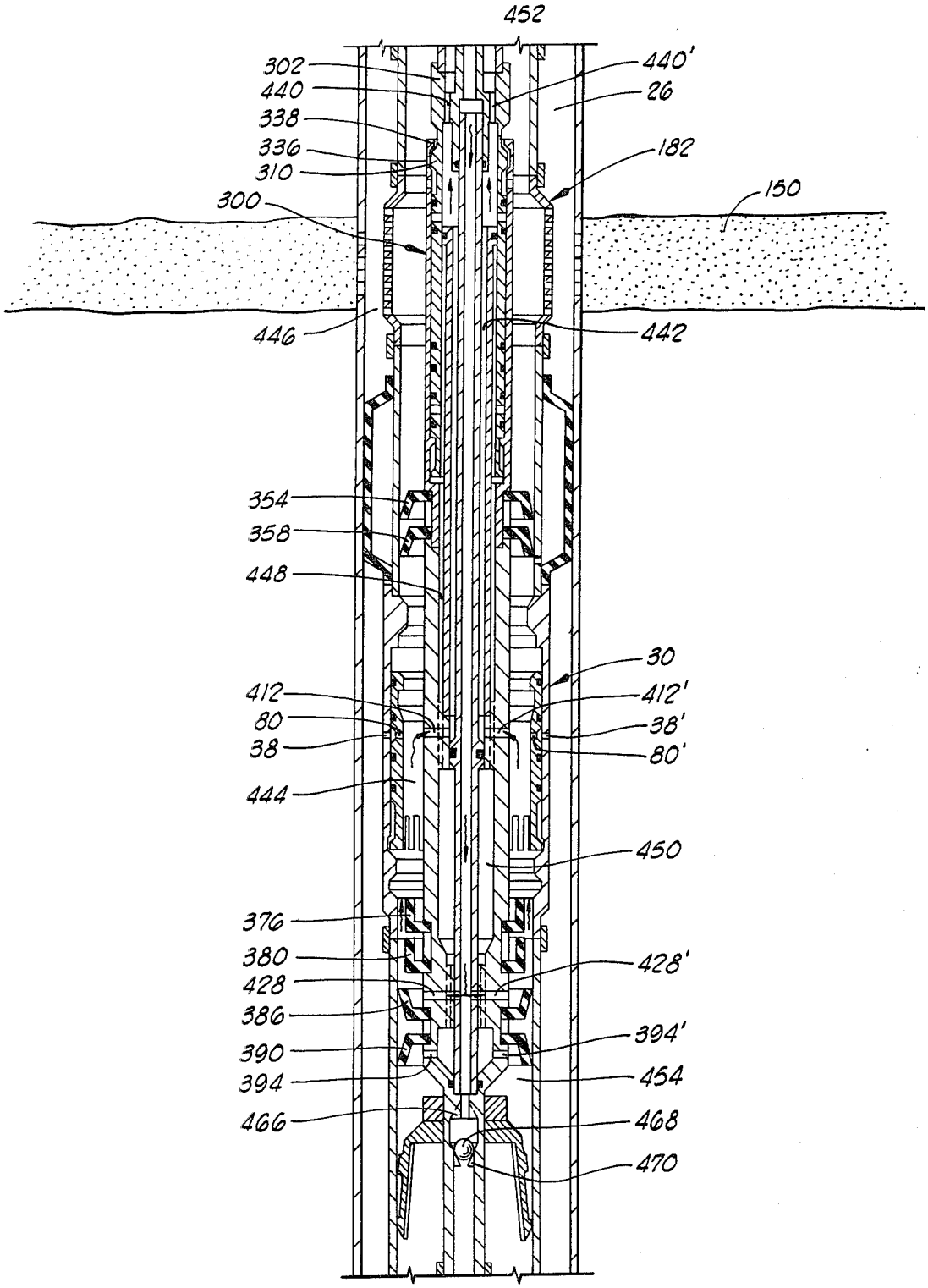
FIG. 5 provides a simplified vertical cross-section of the isolation gravel packer during reverse circulation.

If desired at this point, the gravel pack may be further consolidated by applying pressure to it, referred to as squeezing. Pressure is applied down blank pipe annulus 209, after closing flow from inner blank pipe 208 at the surface, which pressure will act upon the pack through the same circulation path as described previously. Fluid is contained below isolation gravel packer 300 by downward-facing packer cup 390, as during normal circulation. In order to clear the interior of the tool spring 20 of residual slurry, circulation is then reversed using a clean fluid. This operation is illustrated in FIG. 5. No movement in the well bore is required to effect this operation, the only action on the part of the operator being necessary is a reversal of flow direction. Clean fluid is sent down blank pipe 208 to axial circulation passage 452 in isolation gravel packer 300. When the fluid reaches check valve 460, ball 468 is seated on valve seat 470 preventing flow downward. At this point, the clean fluid will then exit isolation gravel packer 300, through lateral circulation passages 428 and 428', and flow upward past collapsed packer cups 380 and 376, and back through gravel passages 412 and 412' into inner annular passage 442, through outer passages 440 and 440' to blank pipe annulus 209. When clean fluid is returned to the surface, the packing job is complete. It is noteworthy that the reversing fluid is prevented from circulating below isolation gravel packer 300 by upward-facing packer cup 386, responsive to the pressure of fluid flow through lateral circulation passages 428 and 428', and as a result of this seal as well as the closing of check valve 460, reverse circulation is effected without fluid movement across the zone just packed.

At this point, the tool string may be moved upward to the next zone of interest 150, in this case between the casing inflation packers 164 and 184. The tool string 20 is reciprocated upward, thus retracting the anchor positioner 220 and disengaging anchor tool 198. As the tool string 20 is pulled up to the next zone, the passing spring arms 130 and 130' of closing sleeve positioner 120 pulls sleeve 58 of lower full open gravel collar 30 upward. The upward facing outwardly radially extending shoulders 136 and 136' of the protrusions on spring arms 130 and 130' engage downward facing annular shoulder 62 in sleeve 58. As the tool string is pulled up, the spring arms 130 and 130' close gravel collar 30, at which point shoulders 132 and 132' encounter necked-down portion 42, which compresses spring arms 130 and 130', releasing them from shoulder 62 of sleeve 58. At this point, annular seals 76 and 78 bracket gravel ports 38 and 38', sealing them. At the next zone, the tool string 20 is turned right and then lowered downward into anchor tool 176. If the casing inflation packer 164 above the upper zone has been previously inflated, this final upward reciprocation can effect the opening of upper gravel collar 30, by engaging sleeve 58 with spring arms 100 and 100' of opening sleeve positioner 90. If casing inflation packer 164 has not been inflated, inflation may proceed as described with respect to packer 184. When spring arms 100 and 100' have opened the upper collar 30 by pulling sleeve 58 upward, they will automatically disengage as the median shoulders thereon encounter necked-down portion 42 which will in turn compress the spring arms.

When the anchor positioner 220 has engaged anchor 176, gravel packing may proceed at this zone (if the packer 164 above it is inflated) as described previously with respect to lower zone 152. After packing of the upper zone of interest 150 is effected, the tool spring 20 is withdrawn. In coming out of the well, closing sleeve positioner will contact every gravel collar 30, thus ensuring a closed liner except at gravel screen locations.

The well may now be produced after any other desired operations have been performed.

The gravel packing operation has been described herein as employing concentric blank pipes running to the surface; however, a crossover device may be placed above the uppermost zone to be packed, and fluid run down a drill pipe to the crossover, return fluid being taken up the annulus surrounding the casing. A crossover device with a shutoff capability may be employed to close the return downhole during a squeeze, rather than at the surface.

Although the invention has been described in terms of a certain embodiment set forth in detail, it should be understood that descriptions herein are by way of illustration and not by way of limitation of the invention. Alternative embodiments of the apparatus and operating techniques of the method will be readily apparent to those of ordinary skill in the art in view of the disclosure. For example, the check valve may be placed at the end of the tail pipe; the redundancy of packer cups may be eliminated; the circulation passages and check valve could be placed above the gravel passages; and a bypass and dump valve mechanism could be employed at the bottom of the isolation gravel packer. Furthermore, one could design the isolation gravel packer in a non-concentric configuration, or redesign the passages so that gravel is pumped down the axial passage and returned up the inner annulus. In the event that one wishes to employ the isolation gravel packer in a single-zone pack, where there is no need to isolate the well bore above the zone from fluid movement, the isolation gravel packer could be used with a single tubing string, using the annulus between the liner and the tubing string as the second flow path and employing, if necessary, another upward-facing packer cup near the top of the isolation gravel packer. Accordingly, modifications such as these and others are contemplated without departing from the spirit and scope of the claimed invention.

We claim:

1. A well treatment apparatus of a type to be disposed within a conduit in a well bore, in fluid communication with first and second tubing means, said apparatus comprising:

treatment means containing first and second passage means, check valve means, and third passage means;

said first passage means in fluid communication with said first tubing means above said treatment means and with the bore of said conduit below said treatment means;

said second passage means in fluid communication with said second tubing means above said treatment means and with the annulus between said treatment means and said conduit;

said check valve means being disposed in said first passage means; and said third passage means being longitudinally fixed and in fluid communication with said annular and with said first passage means above said check valve means.

2. The apparatus of claim 1, wherein said check valve means permits flow in an upward direction, and prohibits flow in a downward direction.

3. The apparatus of claim 2, further comprising:

first and second seal means disposed around said treatment means to bracket said annulus communication point of said second passage means; and third seal means disposed around said treatment means, said annulus communication point of said third passage means being interposed between said third seal means and said second seal means.

4. The apparatus of claim 3 wherein said first and second seal means effect a fluid seal between said treatment means and said conduit means in response to fluid flow out of said second passage means communication point.

5. The apparatus of claim 4 wherein said first and third seal means effect a fluid seal between said treatment means and said conduit means in response to fluid flow out of said third passage means annulus communication point, and said second seal means releases its seal in response thereto.

6. The apparatus of claim 5, further comprising:

fourth seal means disposed around said treatment means below the annulus communication points of said second and third passage means, said fourth seal means effecting a seal in response to a negative pressure differential above said fourth seal means.

7. The apparatus of claim 6 wherein said first and second tubing means comprise, respectively, the bore of a first tube and the space between said first tube and a second, larger tube, said treatment means being attached to said first and second tubes.

8. The apparatus of claim 7 wherein said first and second tubes are concentric.

9. The apparatus of claim 6 wherein said first tubing means comprises the bore of a tubing string and said second tubing means comprises the annulus between said tubing string and said conduit.

10. The apparatus of claim 6, further comprising:

selective fluid bypass means in said treatment means;

said selective fluid bypass means permitting fluid communication between the conduit bore above and that below said treatment means when open, and prohibiting said fluid communication when closed.

11. The apparatus of claim 10 wherein said selective fluid bypass means is opened and closed by application of longitudinal force on said treatment means.

12. The apparatus of claim 11 wherein said selective fluid bypass means is opened by upward force, and closed by downward force.

13. The apparatus of claim 12, further comprising:

selective dump valve means in said treatment means;

said selective dump valve means permitting fluid communication between the conduit bore above said treatment means and the annulus bounded by said first and second seal means when open, and prohibiting such fluid communication when closed.

14. The apparatus of claim 13 wherein said second tubing means comprises the bore of a tube, and said first tubing means comprises the annulus between said tube and said conduit.

15. The apparatus of claim 13 wherein said selective dump valve means is opened and closed by application of longitudinal force on said treatment means.

16. The apparatus of claim 15 wherein said selective dump valve means is opened by upward force, and closed by downward force.

17. The apparatus of claim 16 wherein said upward and downward forces are applied to said treatment means by at least one of said tubing means.

18. The apparatus of claim 17 further comprising fifth seal means proximate the top of said treatment means, said fifth seal means effecting a seal between said treatment means and said conduit in response to a positive pressure differential above said treatment means.

19. The apparatus of claim 18 further comprising:

first and second seal means disposed around said gravel packer, bracketing said second passage annulus entry; and third seal means disposed around said gravel packer, said third passage annulus entry being located between said second and third seal means.

20. The apparatus of claim 19 wherein said first and second seal means effect a seal between said gravel packer and said liner in response to fluid flow out of said second passage annulus entry; and said first and third seal means effect a seal between said gravel packer and said liner in response to fluid flow out of said third passage annulus entry.

21. The apparatus of claim 20 further comprising fourth seal means at the lower end of said gravel packer; said fourth seal means effecting a fluid seal between said gravel packer and said liner in response to a negative pressure differential above said fourth seal means.

22. The apparatus of claim 21 wherein said first, second, third and fourth seal means comprise packer cups.

23. The apparatus of claim 21 wherein said first tubing means comprises the bore of a first tube, and said second tubing means comprises the space between said first tube and the inner wall of a second, larger tube disposed thereabout.

24. The apparatus of claim 21 wherein said second tubing means comprises a tube, and said first tubing means comprises the annulus between said tube and said liner.

25. The apparatus of claim 21 wherein said second tubing means comprises a tube, and said first tubing means comprises the space between said tube and the inner wall of a second, larger tube disposed thereabout.

26. The apparatus of claim 21 wherein said first tubing means comprises the bore of a tube, and said second tubing means comprises the annulus between said tube and said liner.

27. The apparatus of claim 26 further comprising fifth seal means proximate the top of said treatment means, said fifth seal means effecting a seal between said treatment means and said conduit in response to a positive pressure differential above said treatment means.

28. The apparatus of claim 21 further comprising a selectively closable fluid bypass in said gravel packer; said fluid bypass extending from said liner bore above said gravel packer to said liner bore below said gravel packer.

29. The apparatus of claim 28 wherein said bypass is selectively closed by a sliding valve assembly responsive to axial force applied to said gravel packer.

30. The apparatus of claim 29 wherein the direction of said axial closing force is downward.

31. The apparatus of claim 30 wherein said axial closing force is applied through at least one of said tubing means.

32. The apparatus of claim 21 further comprising a selectively closable dump valve in said gravel packer; said dump valve extending from said liner bore above said gravel packer to said annulus between said first and second seal means.

33. The apparatus of claim 32 wherein said dump valve is selectively closed by a sliding valve assembly responsive to axial force applied to said gravel packer.

34. The apparatus of claim 32 wherein the direction of said axial closing force is downward.

35. The apparatus of claim 34 wherein said axial closing force is applied through at least one of said tubing means.

36. An isolation gravel packer of the type in fluid communication with first and second tubing means within a liner in a well bore, said liner having ports therein and a gravel screen below said ports, said isolation gravel packer comprising:

gravel packer means having first, second and third passages therethrough, and a check valve;

said first passage extending from said first tubing means to the bore of said liner below said gravel packer;

said second passage extending from said second tubing means to the annulus between said gravel packer and said liner;

said third passage being longitudinally fixed in said gravel packer means and extending between first passage and said annulus; and said check valve being disposed in said first passage below said third passage.

37. The apparatus of claim 36 wherein said check valve means permits flow in an upward direction, and prohibits flow in a downward direction.

38. A method of gravel packing a producing zone in a well bore, comprising:

(a) placing a conduit having a gravel screen therein in said well bore, said gravel screen being positioned across said zone;

(b) pumping a gravel slurry down first tubing means to a location above said zone;

(c) routing said gravel slurry outside said conduit and down to the level of said gravel screen;

(d) arresting the flow of said gravel with said screen while allowing the slurry carrier fluid to pass therethrough;

(e) returning said carrier fluid to the surface via second tubing means;

(f) continuing steps (d) and (e) until a gravel pack is effected;

(g) pumping fluid down said second tubing means to the vicinity of said zone and returning said fluid to the surface via said first tubing means without inducing fluid movement within the conduit bore area defined by the top and bottom of said gravel screen.

39. A method of gravel packing a producing zone in a well bore, comprising:

(a) disposing a tool string in a well bore, said tool spring having an isolation gravel packer at the lower end;

(b) placing a gravel pack with said isolation gravel packer;

(c) reversing circulation through said isolation gravel packer solely by reversal in the direction of fluid flow through said isolation gravel packer and without the necessity of manipulating said tool string prior or subsequent to said gravel pack placement.

40. The method of claim 39, wherein said reversing circulation is effected without inducing fluid movement across said packed zone.

41. A well treatment apparatus of a type to be disposed within a conduit in a well bore, in fluid communication with first and second tubing means, said apparatus comprising:

treatment means containing first and second passage means, check valve means, and third passage means;

said first passage means in fluid communication with said first tubing means above said treatment means and with the bore of said conduit below said treatment means;

said second passage means in fluid communication with said second tubing means above said treatment means and with the annulus between said treatment means and said conduit;

said check valve means being disposed in said first passage means;

said third passage means in fluid communication with said annulus and with said first passage means above said check valve means;

first and second seal means disposed around said treatment means to bracket said annulus communication point of said second passage means; and third seal means disposed around said treatment means, the annulus communication point of said third passage means being interposed between said third seal means and said second seal means.

42. The apparatus of claim 41, wherein said check valve means permits flow in an upward direction, and prohibits flow in a downward direction.

43. The apparatus of claim 42, wherein said first and second seal means effect a fluid seal between said treatment means and said conduit means in response to fluid flow out of said second passage means communication point.

44. The apparatus of claim 43 wherein said first and third seal means effect a fluid seal between said treatment means and said conduit means in response to fluid flow out of said third passage means annulus communication point, and said second seal means releases its seal in response thereto.

45. The apparatus of claim 44, further comprising:

fourth seal means disposed around said treatment means below the annulus communication points of said second and third passage means, said fourth seal means effecting a seal in response to a negative pressure differential above said fourth seal means.

46. The apparatus of claim 45, further comprising:

selective fluid bypass means in said treatment means;

said selective fluid bypass means permitting fluid communication between the conduit bore above and that below said treatment means when open, and prohibiting said fluid communication when closed.

47. The apparatus of claim 46, wherein said selective fluid bypass means is opened and closed by application of longitudinal force on said treatment means.

48. The apparatus of claim 47, wherein said selective fluid bypass means is opened by upward force, and closed by downward force.

49. The apparatus of claim 48, further comprising:

selective dump valve means in said treatment means;

said selective dump valve means permitting fluid communication between the conduit bore above said treatment means and the annulus bounded by said first and second seal means when open, and prohibiting such fluid communication when closed.

50. The apparatus of claim 49, wherein said selective dump valve means is opened and closed by application of longitudinal force on said treatment means.

51. The apparatus of claim 50, wherein said selective dump valve means is opened by upward force, and closed by downward force.

52. The apparatus of claim 51, wherein said upward and downward forces are applied to said treatment means by at least one of said tubing means.

53. The apparatus of claim 52, wherein said first and second tubing means comprise, respectively, the bore of a first tube and the space between said first tube and a second, larger tube, said treatment means being attached to said first and second tubes.

54. The apparatus of claim 53, wherein said first and second tubes are concentric.

55. The apparatus of claim 54, wherein said first tubing means comprises the bore of a tubing string and said second tubing means comprises the annulus between said tubing string and said conduit.

56. The apparatus of claim 55, further comprising fifth seal means proximate the top of said treatment means, said fifth seal means effecting a seal between said treatment means and said conduit in response to a positive pressure differential above said treatment means.

57. The apparatus of claim 56, wherein said second tubing means comprises the bore of a tube, and said first tubing means comprises the annulus between said tube and said conduit.

* * * * *

UNITED STATES PATENT AND TRADEMARK OFFICE

CERTIFICATE OF CORRECTION

PATENT NO. : 4,295,524

DATED : October 20, 1981

INVENTOR(S) : Eugene E. Baker and David D. Szarka

It is certified that error appears in the above-identified patent and that said Letters Patent is hereby corrected as shown below:

Column 4, line 37, change "spring" second occurrence to --string--
Column 10, line 66, change "havve" to --have--
Column 12, line 11, change "spring" to --string--
Column 12, line 20, change "assembly" to --hanger--
Column 12, line 57, change the number "92" to --192--
Column 14, line 65, change "spring" to --string--

IN THE CLAIMS

Claim 1, line 59, change "annular" to --annulus--
Claim 39, line 50, change "spring" to --string--

Signed and Sealed this

*Eleventh* Day of *January 1983*

[SEAL]

*Attest:*

GERALD J MOSSINGHOFF

*Attesting Officer* *Commissioner of Patents and Trademarks*

UNITED STATES PATENT AND TRADEMARK OFFICE

CERTIFICATE OF CORRECTION

PATENT NO. : 4,295,524

DATED : October 20, 1981

INVENTOR(S) : Eugene E. Baker and David D. Szarka

It is certified that error appears in the above-identified patent and that said Letters Patent is hereby corrected as shown below:

Column 17, line 3, claim 19, change the numeral "18" to --36--.

Signed and Sealed this

*Twenty-eighth* Day of *June 1983*

[SEAL]

*Attest:*

GERALD J. MOSSINGHOFF

*Attesting Officer*

*Commissioner of Patents and Trademarks*